US010780699B2

(12) United States Patent
Clark et al.

(10) Patent No.: US 10,780,699 B2
(45) Date of Patent: Sep. 22, 2020

(54) PRINTHEAD WITH REMOVABLE PRINTHEAD COVER

(71) Applicant: HEWLETT-PACKARD DEVELOPMENT COMPANY, L.P., Houston, TX (US)

(72) Inventors: Garrett E. Clark, Corvallis, OR (US); Mark H. MacKenzie, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/764,273

(22) PCT Filed: Oct. 8, 2015

(86) PCT No.: PCT/US2015/054642
§ 371 (c)(1),
(2) Date: Mar. 28, 2018

(87) PCT Pub. No.: WO2017/062007
PCT Pub. Date: Apr. 13, 2017

(65) Prior Publication Data

US 2018/0281416 A1 Oct. 4, 2018

(51) Int. Cl.
*B41J 2/165* (2006.01)
*B41J 2/175* (2006.01)
*B41J 2/16* (2006.01)

(52) U.S. Cl.
CPC ..... *B41J 2/16505* (2013.01); *B41J 2/1623* (2013.01); *B41J 2/17536* (2013.01)

(58) Field of Classification Search
CPC ... B41J 2/165; B41J 2/175; B41J 2/135; B41J 2/04; B41J 2/01
USPC ..... 347/20, 29, 40, 45, 49
See application file for complete search history.

(56) References Cited

U.S. PATENT DOCUMENTS

| | | | | |
|---|---|---|---|---|
| 5,530,463 | A | 6/1996 | Nystrom | |
| 6,164,769 | A | 12/2000 | Inada | |
| 6,254,227 | B1 | 7/2001 | Merz | |
| 6,644,781 | B2 * | 11/2003 | Silverbrook | B41J 2/14024 347/13 |
| 2003/0052939 | A1 | 3/2003 | Farr | |
| 2005/0157044 | A1 | 7/2005 | Silverbrook | |
| 2006/0139403 | A1 | 6/2006 | Ma | |
| 2008/0100669 | A1 | 5/2008 | Ciere | |

(Continued)

FOREIGN PATENT DOCUMENTS

WO WO-2014209506 12/2014

OTHER PUBLICATIONS

"The V320i Thermal Transfer Printer"; Apr. 8, 2011; Domino; <http://www.ema.si/ema_resource/ema_documents/pdf/50-Domino%20V320i%20EN%20Brochure%20Issue%202%20Web.pdf>.

*Primary Examiner* — An H Do
(74) *Attorney, Agent, or Firm* — Fabian VanCott

(57) ABSTRACT

In one example in accordance with the present disclosure a printhead is described. The printhead includes a number of nozzles to deposit an amount of fluid onto a print medium and an ink delivery system to deliver the amount of fluid from an ink tank to the number of nozzles. The printhead also includes an attachment feature to removably couple a removable printhead cover to the printhead. The printhead further includes a removable printhead cover removably coupled to the printhead at the attachment feature.

15 Claims, 7 Drawing Sheets

(56) References Cited

U.S. PATENT DOCUMENTS

| | | | |
|---|---|---|---|
| 2011/0279613 | A1 | 11/2011 | Mandel |
| 2013/0016157 | A1 | 1/2013 | Akici |

* cited by examiner

PRINTHEAD WITH REMOVABLE PRINTHEAD COVER

BACKGROUND

Printing systems are used to deposit printing fluid such as ink, onto a print medium such as paper. The printing system includes a fluid supply, such as an ink reservoir, that contains fluid that is eventually deposited onto the print medium. A fluid delivery system transports the printing fluid from the fluid supply to a printhead. The printhead of the printing system is the assembly that deposits the ink or other printing fluid onto the print medium.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1A:
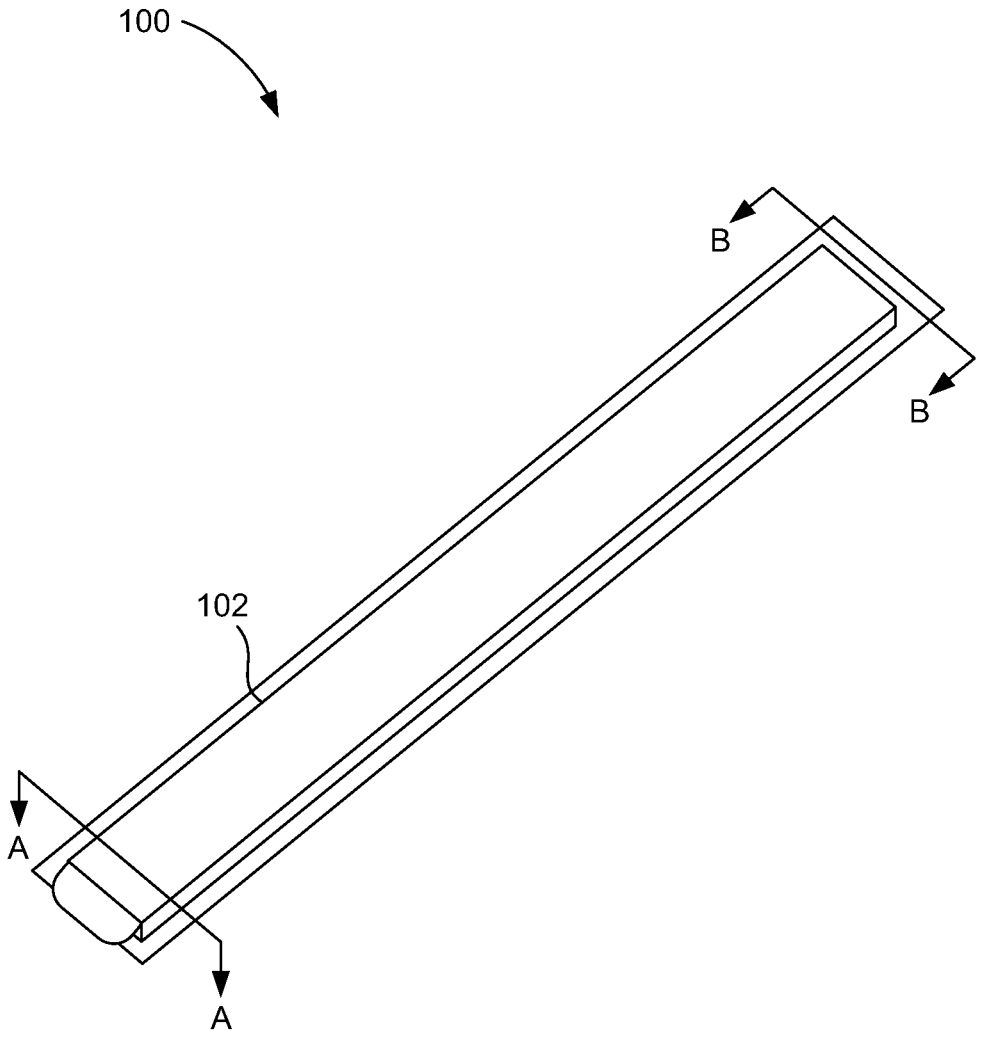
FIGS. 1A-1C are views of a printhead with a removable printhead cover, according to one example of the principles described herein.

As described above, printheads are used to deliver ink, or other printing fluid, from a fluid supply reservoir onto a print medium such as paper. Such printheads include printhead dies that have openings through which the printing fluid passes from the printing system onto the paper. Prior to ejection a small amount of printing fluid resides in a firing chamber of the printhead and an ejector such as a thermo-resistor or a piezo-resistive device creates pressure that forces a portion of the printing fluid from the firing chamber, through the opening, and onto the print medium. One particular type of printhead is a page wide printhead where an array of printhead dies span the printing width of the print medium. While such printing systems are efficient in depositing ink, or other printing fluid, onto a print medium, printhead functionality may be degraded in some environments.

For example, during shipment, the complex components of the printhead may become damaged. Still further, in some examples, the printhead may be shipped with printing fluid such as ink contained therein. In this example, during shipment, the printing fluid that fills the nozzles may leak out the nozzles due to gravity or pressure differentials experienced while shipping. Similarly, during shipping, the printing fluid may harden and block the nozzles, thus removing a nozzles ability to expel the printing fluid on to a print medium.

The printheads and methods of the present specification and the appended claims address these and other issues. Specifically, the present application describes a printhead that has a semi-rigid removable protective cover. The cover may be made out of a metallic foil, plastic material or other material that protects the printhead dies, but that can be removed to expose the printhead nozzles for ejection of fluid onto a print medium.

Specifically, the present specification describes a printhead that includes a number of nozzles to deposit an amount of fluid onto a print medium and a fluid delivery system to deliver the amount of fluid from a fluid supply to the number of nozzles. The printhead also includes an attachment feature to removably couple a removable printhead cover to the printhead and a printhead cover removably coupled to the printhead at the attachment feature.

The present specification also describes a method for forming the printhead. The method includes forming a printhead that includes a number of printhead dies. A printhead die includes a number of nozzles and a fluid delivery system. An attachment feature is formed and attached to the printhead. The attachment feature surrounds the number of nozzles and receives a removable printhead cover. The removable printhead cover is removably coupled to the printhead at the attachment feature so that a gap is formed between the number of printhead dies and the printhead cover.

The present application also describes a printhead that includes a number of fluidic ejection devices, each fluidic ejection device includes a firing chamber to hold an amount of fluid, an opening to dispense the amount of fluid onto a print medium, and an ejector to eject the amount of fluid through the opening. The printhead also includes a removable printhead cover removably coupled to the printhead at the attachment feature. The removable printhead cover forms a gap between the openings and the removable printhead cover.

Certain examples of the present disclosure are directed to printheads and methods for forming a printhead with a removable printhead cover that provides a number of advantages not previously offered including 1) providing a low cost shipping cover; 2) containing the ink within the nozzles; 3) protecting the printhead dies; 4) regulating the pressure within the printhead; 5) establishing a desired humidity level to maintain the ink in liquid form and keep the ink from drying out; and 6) retaining ink that is expelled from the nozzle during shipping. However, it is contemplated that the devices and methods disclosed herein may prove useful in addressing other deficiencies in a number of technical areas. Therefore the systems and devices disclosed herein should not be construed as addressing just the particular elements or deficiencies discussed herein.

As used in the present specification and in the appended claims, the term "removably coupled" refers to a juncture of two components that in one state is attached and in another state is detached. For example, in an initial state the printhead cover may be attached, but due to an exerted force may be removed from the printhead without any impact on the functionality of the printhead.

Still further, as used in the present specification and in the appended claims, the term "a number of" or similar language is meant to be understood broadly as any positive number including 1 to infinity; zero not being a number, but the absence of a number.

In the following description, for purposes of explanation, numerous specific details are set forth in order to provide a thorough understanding of the present systems and methods.

It will be apparent, however, to one skilled in the art that the present apparatus, systems, and methods may be practiced without these specific details. Reference in the specification to "an example" or similar language indicates that a particular feature, structure, or characteristic described in connection with that example is included as described, but may not be included in other examples.

Figure 1B:
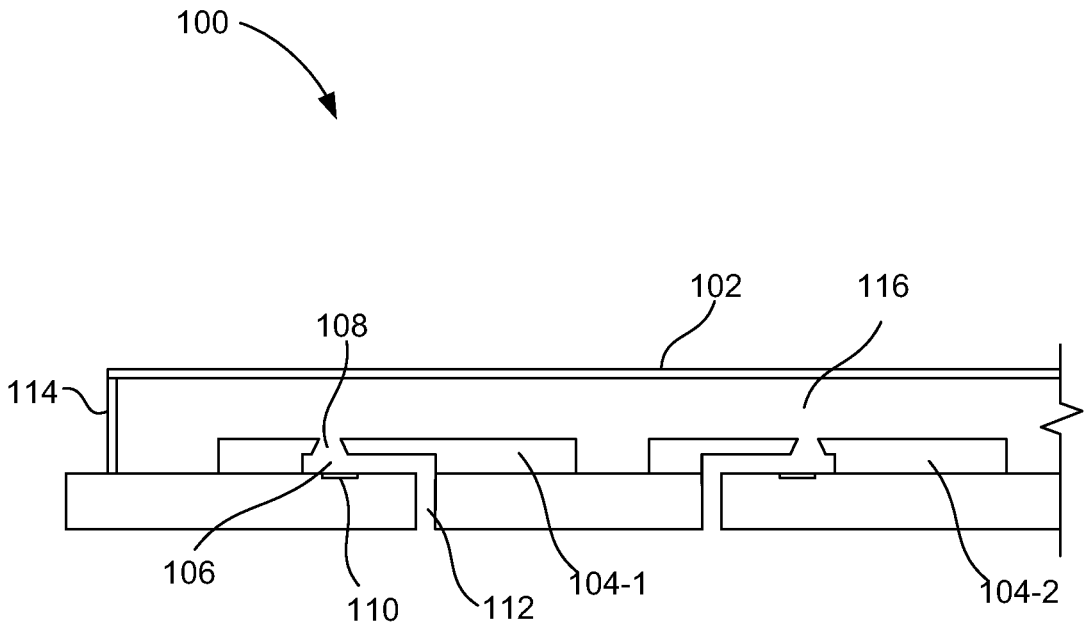
Figure 1C:
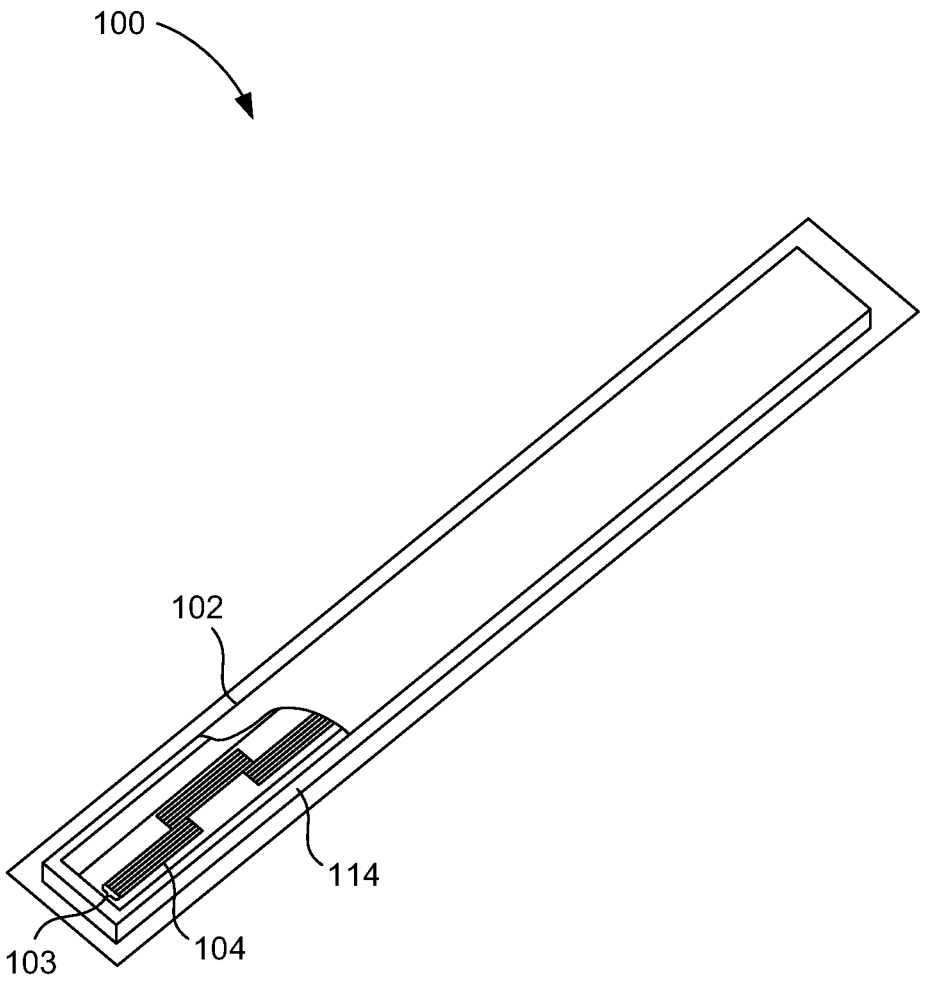

FIGS. 1A-1C are views of a printhead (100) with a removable printhead cover (102), according to one example of the principles described herein. Specifically, FIG. 1A is a perspective view of the printhead (100) with the printhead cover (102) fully covering the printhead dies (104). FIG. 1B is a portion of a cross-sectional view taken along the line A from FIG. 1A showing the gap (116) created between the removable printhead cover (102) and the printhead dies (104). FIG. 1C, is a perspective view of the printhead (100) with the printhead cover (102) partially cut away to show the printhead dies (104) thereunder. FIG. 1C also clearly depicts the attachment feature (114) used to 1) join the removable printhead cover (102) to the printhead (100) and 2) mechanically protect the printhead dies (104). For simplicity in FIG. 1C, one printhead die (104) is indicated with a reference number. However, a printhead (100) may include any number of printhead dies (104). A printhead die (104) includes a number of nozzles to deposit an amount of fluid onto a print medium. The nozzles may be arranged in rows, columns, or other forms of arrays to deposit the fluid onto a print medium. While the figures and present specification depict a number of printhead dies (104) grouped together, and a number of printhead die groups (103), any number of printhead die (104) constructions and configurations can be implemented in line with the present disclosure.

The printhead (100) may be any type of printhead (100) including a page-wide printhead (100) wherein the printhead is the same width, or nearly the same width of the print media in a direction perpendicular to a media transport. More specifically, given a printing page width of 8.5 inches. A page-wide printhead (100) may be 8.5 inches wide or slightly wider to form a border or to accommodate components at the peripheries of the printhead (100). A page-wide printhead (100) alleviates lateral movement of either the print medium or the printhead (100) when depositing printing fluid onto the print medium. This reduces the likelihood of breakdown due to the mechanical devices that would otherwise be used to move the printhead (100), the print medium, or combinations thereof. The examples shown in the corresponding figures are not meant to limit the present description. Instead, various types of printheads (100) may be used in conjunction with the principles described herein.

In some examples, the printhead (100) is an integrated printhead (100) meaning that the printhead (100) and the fluid supply are housed together in the same physical structure. In another example, the printhead (100) may be separated from the fluid supply. In this example, the printhead (100) is fluidly connected to the fluid supply by a coupling and/or interface connection.

The printhead (100) may include a number of components for depositing a fluid onto a surface. For example, as can be seen in FIG. 1B, the printhead (100) includes a number of nozzles to deposit an amount of fluid onto a print medium. Each nozzle includes a firing chamber (106) to hold the amount of fluid that is to be deposited onto the print medium The amount of fluid is dispensed through an opening (108) onto a print medium, and an ejector (110) ejects the amount of fluid through the opening (108). For simplicity, one instance of some of these components are identified with a reference number, however, each printhead die (104-1, 104-2) includes similar components.

The ejector (110) ejects the amount of fluid through the opening (108). The ejector (110) may include a firing resistor or other thermal device, a piezoelectric element, or other mechanism for ejecting fluid from the firing chamber (106). For example, the ejector (110) may be a firing resistor. The firing resistor heats up in response to an applied voltage. As the firing resistor heats up, a portion of the fluid in the firing chamber (106) vaporizes to form a bubble. This bubble pushes liquid fluid out the opening (108) and onto the print medium. As the vaporized fluid bubble pops, a vacuum pressure within the firing chamber (106) draws fluid into the firing chamber (106) from the fluid supply, and the process repeats. In this example, the printhead (100) may be a thermal inkjet printhead (100). In this example, the fluid is inkjet ink.

In another example, the ejector (110) may be a piezoelectric device. As a voltage is applied, the piezoelectric device changes shape which generates a pressure pulse in the firing chamber (106) that pushes a fluid out the opening and onto the print medium. In this example, the printhead (100) may be a piezoelectric inkjet printhead. The printhead (100) also includes a fluid delivery system (112) to deliver an amount of fluid from a fluid supply to the number of openings (108). The fluid delivery system (112) may include a channel that passes from the backside of the printhead (100) to the openings (108) which are disposed on a front side of the printhead die (104).

The nozzles of the printhead dies (104) may be arranged in columns or arrays such that properly sequenced ejection of fluid from the nozzles causes characters, symbols, and/or other graphics or images to be printed on the print medium. In one example, the number of nozzles fired may be a number less than the total number of nozzles available and defined on the printhead (100).

In an example where the fluid is an ink, a first subset of nozzles may eject a first color of ink while a second subset of nozzles may eject a second color of ink. Additional groups of nozzles may be reserved for additional colors of ink. To create an image, at appropriate times, electrical signals passed to the printhead (100) that cause the printhead (100) to eject small droplets of fluid from the nozzles onto the surface of the print medium. These droplets combine to form an image on the surface of the print medium. As used in the present specification and in the appended claims, the print medium may be any type of suitable sheet or roll material, such as paper, card stock, transparencies, polyester, plywood, foam board, fabric, canvas, and the like. In another example, the print medium may be an edible substrate. While a specific printhead die (104) configuration is illustrated in FIGS. 1A-1C, any number of printhead die (104) constructions and configurations can be implemented in line with the present disclosure.

The printhead (100) also includes an attachment feature (114) to removably couple the removable printhead cover (102) to the printhead (100). For example, the attachment feature (114) may be a ridge on the printhead (100) that surrounds the number of nozzles of the printhead (100). While FIGS. 1A-2C depict the attachment feature (114) on a top surface of the printhead (100), the attachment feature (114) may be on any surface of the printhead (100) including around the side surfaces of the printhead (100) so long as the nozzles of the printhead dies (104) are encompassed by the combination of the attachment feature (114) and the removable printhead cover (102). Moreover, in some examples, the attachment feature (114) may be formed on a substrate on which the printhead (100) is mounted, for example a printer pen body, or a printer cartridge body.

In some examples, the attachment feature (114) is an integrated portion of the printhead (100). In other words, the attachment feature (114) may be formed at the same time, and/or out of the same material as the printhead (100). For example, as depicted in FIGS. 1A-1C and FIG. 2A, the attachment feature (114) may be an integrated and raised feature extending from an exterior surface of the printhead (100) and that surrounds the openings (108) to receive the removable printhead cover (102). In this example, the printhead (100) and the attachment feature (114) may be molded at the same time out of an epoxy mold compound.

In other examples, the attachment feature (114) is coupled to the removable printhead cover (102). In this example, as the printhead cover (102) is removed, the attachment feature (114) is similarly removed as depicted in FIG. 2B. By comparison, when the attachment feature (114) is integrated with the printhead (100), upon removal of the printhead cover (102), the attachment feature (114) remains with the printhead (100) as depicted in FIG. 2A. Coupling the attachment feature (114) to the removable printhead cover (102) allows for the removal of the attachment feature (114), i.e., the ridge, which would reduce the impact of the attachment feature (114) during printing operations of the printhead (100).

The printhead (100) also includes a removable printhead cover (102) that is removably coupled to the printhead (100) via the attachment feature (114). The printhead cover (102) may be formed of a material different from a material that forms the printhead (100) and the attachment feature (114). For example, the printhead cover (102) may be a thin plastic or a thin metallic foil whereas the printhead (100) and the attachment feature (114) may be formed of a glass-infused thermo-molded plastic. The printhead cover (102) may be formed of a thin material so as to pull away from the printhead (100) while the printhead cover (102) is removed from the printhead (100). In some examples, the printhead cover (102) is non-permeable meaning that air, vapor, and other gases cannot transfer through the cover (102). Such a non-permeable printhead cover (102) allows for environmental conditions to be established inside the gap (116) created between the printhead cover (102) and the printhead dies (104) and to increase the protection afforded by the printhead cover (102). For example, a certain humidity and air pressure may be established within the gap (116) for example to preserve the nozzles and ink present therein. The non-permeable printhead cover (102) ensures that such environmental conditions are maintained during shipping and up to when the printhead (100) is to be used. A metallic or plastic printhead cover (102) may also allow for increased protection as it is not as susceptible to tearing.

The printhead (100) is removably coupled to the printhead cover (102) via an adhesive. For example, during manufacturing, the printhead cover (102) may be disposed on the attachment feature (114) so as to cover the openings (108). Either the printhead (100) or the printhead cover (102) may include an adhesive that with or without heat and pressure seals the printhead cover (102) to the printhead (100).

The removable printhead cover (102) may be disposed on the printhead (100) so as to form a gap (116) between the openings (108) and the removable printhead cover (102). In other words, the attachment feature (114) may be tall enough such that when it is removably coupled to the printhead cover (102), the printhead cover (102) does not touch the openings (108). A cover that is in contact with the openings (108) may present an undesirable user experience as ink that is expelled from the openings (108) during shipment is dispersed across a cover that is in contact with the openings (108) and may get on the user's skin and/or clothing. The printhead (100) of the present specification avoids this situation. Moreover, a printhead cover that is in contact with the openings (108) may facilitate of drying out of the immediately adjacent fluid in the firing chamber (106) which drying out may block the openings (108) with dried ink and thereby inhibit ink distribution.

The printhead (100) with the removable printhead cover (102) that forms a gap between the printhead cover (102) allows for protection of the printhead dies (104) during shipping as well as establishing certain environmental conditions in the gap (116) formed therein. For example, during shipping, the printhead (100) may be roughly handled. Such rough handling could damage the fragile, complex, and small printhead components. Accordingly, the printhead (100) with the removable and raised printhead cover (102) avoids this situation as the attachment feature (114) would take the brunt of any mechanical force. Moreover, when the printhead (100) is a printhead (100) that uses liquid ink, the printhead cover (102) retains the ink that may be expelled during shipping and also prevents contaminants from contacting the nozzles, and more specifically, the openings (108).

Figure 2:
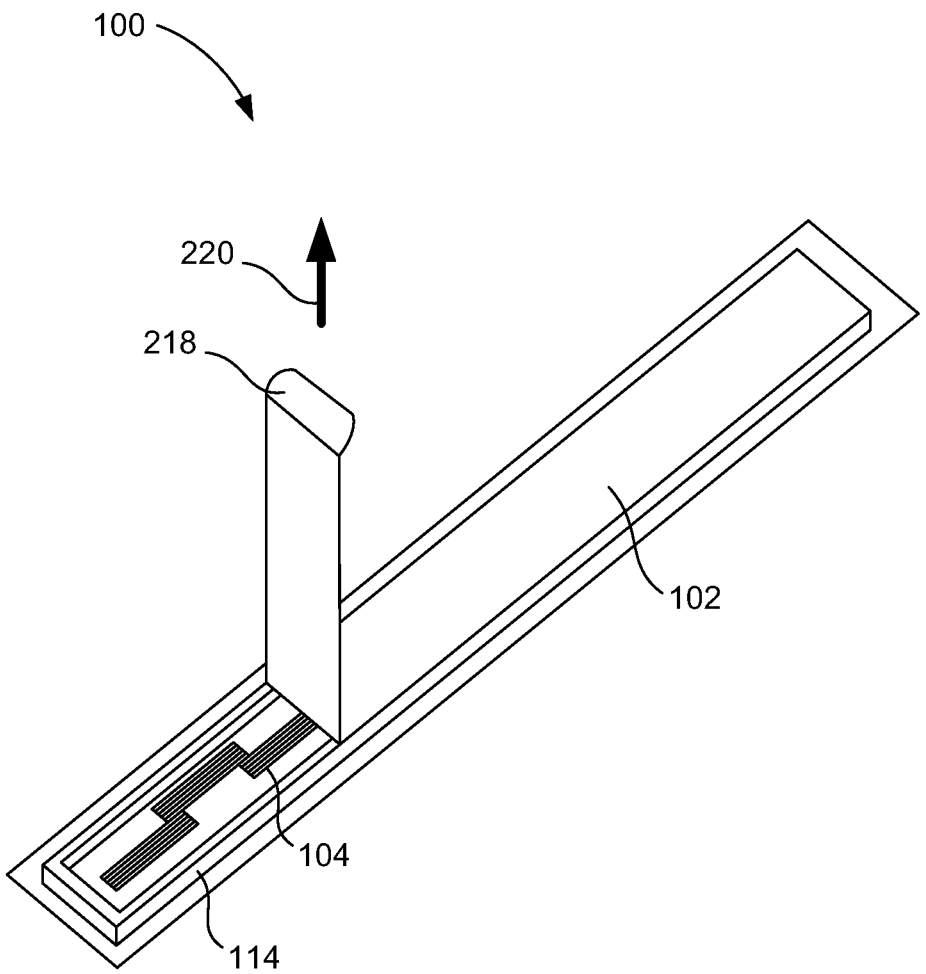
FIG. 2 is a perspective view of a removable printhead cover being removed from a printhead, according to one example of the principles described herein.

FIG. 2 is a perspective view of a removable printhead cover (102) being removed from a printhead (100), according to one example of the principles described herein. As described above, the removable printhead cover (102) is removably coupled to a printhead (100) such that the printhead cover (102) is removed after shipping and prior to use. For example, during shipping, the printhead cover (102) may fully cover the printhead dies (104) as illustrated in FIGS. 1A-1C. Upon receipt by a customer, the user may remove the printhead cover (102), for example by grasping a removal tab (218) and pulling the printhead cover (102) away from the printhead (100) as indicated by the arrow (220). While FIG. 2 depicts the removal tab (218) as a rectangular component, the removal tab (218) may take any form or shape such as a ring through which a user may insert a finger. Moreover, while FIG. 2 depicts a removal tab (218) as a solid piece of material, the removal tab may take any form that allows the removable cover (102) to be removed from the printhead (100) to expose the printhead dies and corresponding nozzles.

In the example depicted in FIG. 2, the attachment feature (114) is attached to the printhead (100) such that it is not removed as the printhead cover (102) is removed. Rather, as depicted in FIG. 2, the attachment feature (114) is retained on the printhead (100) and remains there during printing operations carried out by the printhead (100).

Figure 3:
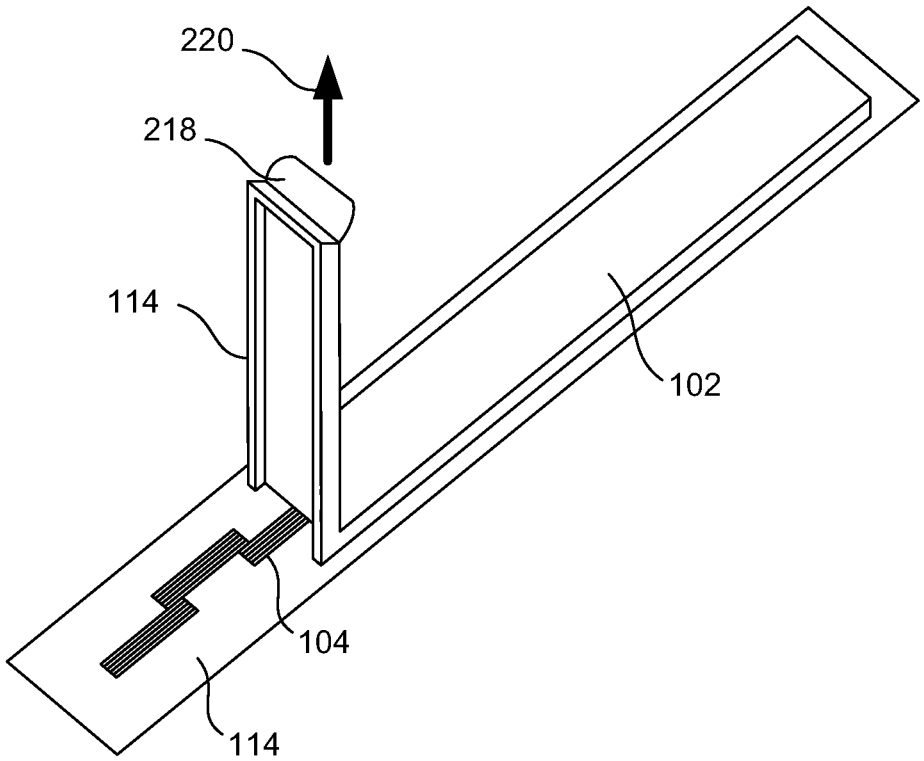
FIG. 3 is a perspective view of a removable printhead cover being removed from a printhead, according to one example of the principles described herein.

FIG. 3 is a perspective view of a removable printhead cover (102) being removed from a printhead (100), according to one example of the principles described herein. In the example depicted in FIG. 3, the attachment feature (114) is attached to the removable printhead cover (102) such that it is removed as the printhead cover (102) is removed. As depicted in FIG. 3, in this example, the attachment feature (114) is not retained on the printhead (100) which avoids the risk that the attachment feature (114) interferes with printing operations and allows the printhead (100) to be placed closer to the print medium during print operations.

Figure 4:
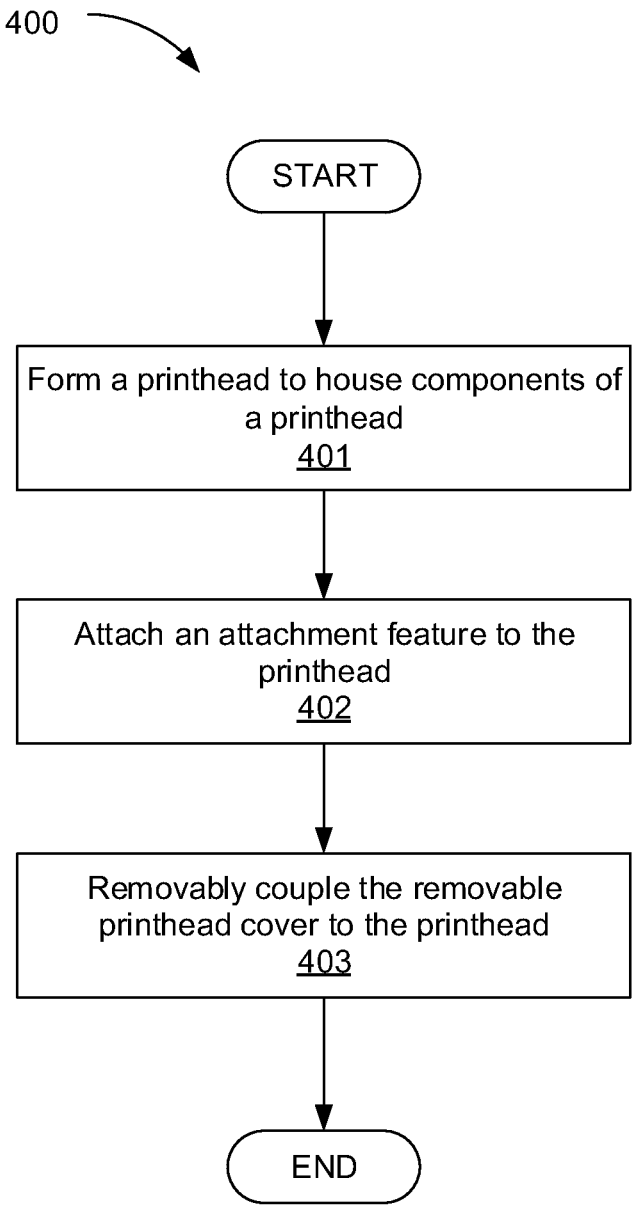
FIG. 4 is a flowchart of a method of forming a printhead with a removable printhead cover, according to one example of the principles described herein.

FIG. 4 is a flowchart of a method (400) of forming a printhead (FIG. 1, 100) with a removable printhead cover (FIG. 1, 102), according to one example of the principles described herein. According to the method (400) a printhead (FIG. 1, 100) is formed (block 401). The printhead (FIG. 1, 100) includes a number of printhead dies (FIG. 1, 104) which printhead dies (FIG. 1, 104) include such components as openings (FIG. 1, 108), firing chambers (FIG. 1, 106), and ejectors (FIG. 1, 110). These components may be found on a printhead die (FIG. 1, 104) that is formed from epoxy mold compound and silicon. Forming (block 401) the printhead (FIG. 1, 100) may include overmolding the printhead to the desired shape. The printhead die (FIG. 1, 104), or printhead die(s) are disposed on the printhead (FIG. 1, 100) which printhead may be epoxy mold compound.

An attachment feature (FIG. 1, 114) may then be attached (block 402) to the printhead (FIG. 1, 100). As described above, the attachment feature (FIG. 1, 114) may be a raised ridge that is integral to either the printhead (FIG. 1, 100) or the removable printhead cover (FIG. 1, 102) in different examples. The attachment feature (FIG. 1, 114) surrounds the number of nozzles so as to protect them from mechanical damage. The attachment feature (FIG. 1, 114) is also to receive the removable printhead cover (FIG. 1, 102), which removable printhead cover (FIG. 1, 102) prevents the ink, or other fluid, from spilling outside of the printhead (FIG. 1, 100). In some examples, forming and attaching the attachment feature (FIG. 1, 114) to the printhead (FIG. 1, 100) is one operation. For example, both the printhead (FIG. 1, 100) and the attachment feature (FIG. 1, 114) may be overmolded at the same time, for example via the same mold both from an epoxy mold compound.

The printhead cover (FIG. 1, 102) may be formed of a semi-rigid material. For example, an aluminum foil or thin film of plastic may be used to form the printhead cover (FIG. 1, 102). The semi-rigid nature of the printhead cover (FIG. 1, 102) offers mechanical protection of the nozzles and creating a barrier to air, water, and other contaminants. The semi-rigid nature of the printhead cover (FIG. 1, 102) also facilitates the easy removal of the printhead cover (FIG. 1, 102) by a user.

The removable printhead cover (FIG. 1, 102) is removably coupled (block 403) to the printhead (FIG. 1, 100). Such removable coupling may include the use of an adhesive. For example, either or both of the printhead cover (FIG. 1, 102) and the attachment feature (FIG. 1, 114) may include an adhesive layer. Once the printhead (FIG. 1, 100) and the removable printhead cover (FIG. 1, 102) are aligned such that the nozzles are covered by the printhead cover (FIG. 1, 102), heat and/or pressure may be applied to cure the adhesive so as to create a temporary seal between the printhead cover (FIG. 1, 102) and the attachment feature (FIG. 1, 114) which temporary seal is broken as the user removes the printhead cover (FIG. 1, 102) prior to use in a printing operation.

Figure 5:
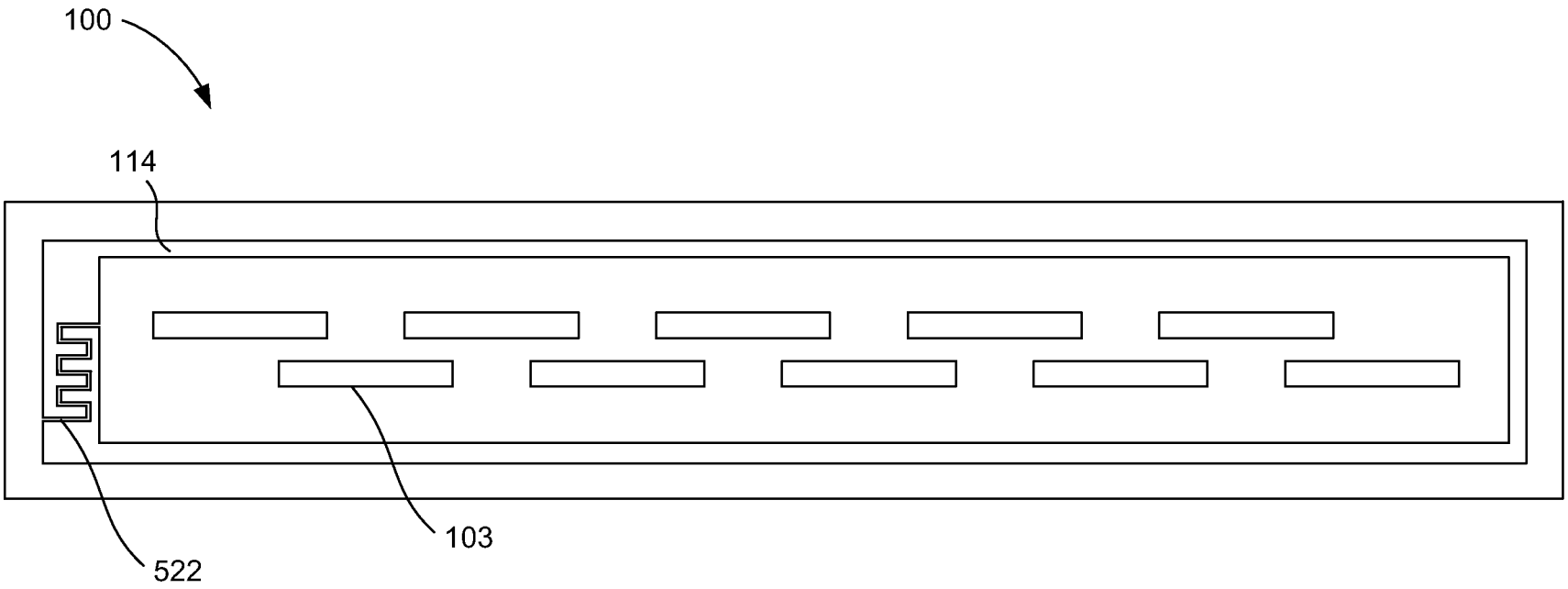
FIG. 5 is a cross-sectional top view of a printhead with a removable printhead cover, according to one example of the principles described herein.

FIG. 5 is a top view of a printhead (FIG. 1, 100) with a removable printhead cover (FIG. 1, 102), according to one example of the principles described herein. Specifically, FIG. 5 is a cross-sectional view taken along the line B from FIG. 1A. As depicted in FIG. 5, the attachment feature (114) encompasses the number of printhead die groups (103) that are found on the printhead (100). For purposes of illustration, individual printhead dies (FIG. 1, 104) are not illustrated; rather printhead die groups (103) are illustrated. Moreover as stated above, while the figures depict a particular printhead die (FIG. 1, 104) configuration and printhead die group (103) orientation, any grouping or configuration of the printhead dies (FIG. 1, 104) may be implemented in line with the present disclosure. In some examples, the attachment feature (114) includes a passageway (522) connecting the space (FIG. 1, 116) with ambient air. The passageway (522) may facilitate humidity control and ventilation. For example, during shipping, the space (FIG. 1, 116) may be exposed to increased or reduced levels of air pressure and humidity. Via the passageway (522), and the configuration thereof, the air pressure and humidity within the space (FIG. 1, 116) may be regulated so as to preserve the nozzles and printhead dies (FIG. 1, 104).

Certain examples of the present disclosure are directed to printheads and methods for forming a printhead with a removable printhead cover that provides a number of advantages not previously offered including 1) providing a low cost shipping cover; 2) containing the ink within the nozzles; 3) protecting the printhead dies; 4) regulating the pressure within the printhead; 5) establish a desired humidity level to maintain the ink in liquid form and keep the ink from drying out; and 6) retaining ink that is expelled from the nozzle during shipping. However, it is contemplated that the devices and methods disclosed herein may prove useful in addressing other deficiencies in a number of technical areas. Therefore the systems and devices disclosed herein should not be construed as addressing just the particular elements or deficiencies discussed herein.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printhead comprising:

a number of printhead dies the number of printhead dies including a number of nozzles and a fluid delivery system;

an attachment feature to the printhead, the attachment feature to surround the number of printhead dies and receive a removable printhead cover;

wherein the removable printhead cover is removeably coupled to the printhead via the attachment feature such that a gap is formed between the number of printhead dies and the printhead cover.

2. The printhead of claim 1, wherein:

the fluid is inkjet ink; and the printhead is an inkjet printhead.

3. The printhead of claim 1, wherein the printhead is an integrated printhead.

4. The printhead of claim 1, wherein the printhead is separate from a fluid supply.

5. The printhead of claim 1, wherein the attachment feature is a ridge formed on the printhead to surround the number of nozzles of the printhead.

6. The printhead of claim 1, wherein the attachment feature is a portion of the removable printhead cover.

7. The printhead of claim 1, wherein the removable printhead cover is formed of a material different from a material that forms the printhead.

8. The printhead of claim 1, wherein the removable printhead cover is formed of a metallic material or a plastic material.

9. A method for forming a printhead comprising:

forming the printhead, the printhead including a number of printhead dies, the number of printhead dies including a number of nozzles and a fluid delivery system;

attaching an attachment feature to the printhead to:

surround the number of printhead dies; and receive a removable printhead cover; and removably coupling the removable printhead cover to the printhead via the attachment feature such that a gap is formed between the number of printhead dies and the printhead cover.

10. The method of claim 9, wherein removably coupling the removable printhead cover to the printhead comprises attaching the removable printhead cover to the printhead with an adhesive.

11. The method of claim 9, wherein the attachment feature is formed of the same material as the printhead and is formed at the same time as the printhead.

12. The method of claim 9, wherein the printhead and the attachment feature are formed out of epoxy mold compound.

13. A printhead comprising:

a number of nozzles to deposit an amount of fluid onto a print medium, each nozzle comprising;

a firing chamber to hold the amount of fluid;

an opening to dispense the amount of fluid onto a print medium; and an ejector to eject the amount of fluid through the opening;

an integrated raised attachment feature extending out from an exterior surface of the printhead and surrounding the openings to receive a removable printhead cover; and the removable printhead cover removably coupled to the printhead at the attachment feature, wherein the removable printhead cover forms a gap between the openings and the removable printhead cover.

14. The printhead of claim 13, wherein the printhead is part of a page-wide printhead array.

15. The printhead of claim 13, wherein the integrated raised attachment feature further comprises a labyrinth to form an air passage from a volume defined by the gap to ambient air.

* * * * *